US008470061B2

(12) United States Patent
Goldsmith et al.

(10) Patent No.: US 8,470,061 B2
(45) Date of Patent: Jun. 25, 2013

(54) NON-ABRASIVE BACK COAT FOR COATED ABRASIVES

(75) Inventors: Paul S. Goldsmith, Stow, MA (US); John F. Porter, St. Catharines (CA); Anthony C. Gaeta, Lockport, NY (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 19 days.

(21) Appl. No.: 13/117,393

(22) Filed: May 27, 2011

(65) Prior Publication Data

US 2012/0055096 A1 Mar. 8, 2012

Related U.S. Application Data

(60) Provisional application No. 61/349,539, filed on May 28, 2010.

(51) Int. Cl.

| | |
|---|---|
| ***B24D 11/00*** | (2006.01) |
| ***B24D 3/28*** | (2006.01) |
| ***B24B 1/00*** | (2006.01) |

(52) U.S. Cl.
USPC ..... 51/295; 51/298; 451/28

(58) Field of Classification Search
USPC ..... 51/295, 298; 451/28; 428/141
See application file for complete search history.

(56) References Cited

U.S. PATENT DOCUMENTS

| | | | | |
|---|---|---|---|---|
| 5,830,248 | A * | 11/1998 | Christianson et al. | 51/295 |
| 6,217,413 | B1 | 4/2001 | Christianson | |
| 2004/0029511 | A1 | 2/2004 | Kincaid et al. | |
| 2006/0026905 | A1 | 2/2006 | Kim | |
| 2007/0243798 | A1 | 10/2007 | Annen et al. | |
| 2009/0035519 | A1 | 2/2009 | Gaeta et al. | |
| 2009/0041983 | A1 * | 2/2009 | Gaeta et al. | 428/141 |
| 2009/0325466 | A1 * | 12/2009 | Kincaid et al. | 451/28 |

FOREIGN PATENT DOCUMENTS

| | | | |
|---|---|---|---|
| WO | 2010/002697 | A2 | 1/2010 |
| WO | 2011/150326 | A2 | 12/2011 |

OTHER PUBLICATIONS

International Search Report dated Jan. 19, 2012 for PCT/US11/38328.
3M, "401Q Imperial Wedordry Paper", 1 page.
3M Industrial Adhesives and Tapes Division, Material Safely Data Sheet: 3M™ Scotch(r) and Tartan™ Box Sealing Tapes—Rubber Adhesive Series (255, 351, 353, 355, 369, 371, 372, 373, 375, 3331, 3721, 3723, 3732, 3734, 3779, 3781, 3782, 3783, 3785), Aug. 19, 2010, 7 pages.
Norton, "Coated Abrasive Rolls: Norton Metalite Q151 & Q153 Micro-finishing File Roll", 1 page.
Norton, "Sheets—Black Ice T214 Waterproof Paper", Accessed Nov. 10, 2011, 1 page.

* cited by examiner

*Primary Examiner* — Pegah Parvini
(74) *Attorney, Agent, or Firm* — Joseph P. Sullivan; Abel Law Group, LLP

(57) ABSTRACT

An abrasive article includes a backing including first and second major surfaces, an abrasive layer disposed over the first major surface, and a back coat layer disposed over the second major surface. The back coat layer includes a polymeric material and a fabric.

20 Claims, 7 Drawing Sheets

NON-ABRASIVE BACK COAT FOR COATED ABRASIVES

CROSS-REFERENCE TO RELATED APPLICATION(S)

The present application claims priority from U.S. Provisional Patent Application No. 61/349,539, filed May 28, 2010, entitled "NON-ABRASIVE BACK COAT FOR COATED ABRASIVES," naming inventors Paul S. Goldsmith, John Porter and Anthony C. Gaeta, which application is incorporated by reference herein in its entirety.

FIELD OF THE DISCLOSURE

This disclosure, in general, relates to a non-abrasive back coat for coated abrasives.

BACKGROUND

Abrasive articles, such as coated abrasives and bonded abrasives, are used in various industries to machine workpieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine and polish surfaces, and oftentimes desire a uniformly smooth surface. Similarly, optics manufacturers desire abrasive articles that produce defect free surfaces to prevent light diffraction and scattering.

While the abrasive surfaces of the abrasive article generally influence stock removal rate and surface quality, a poor backing material can lead to degradation in other performance factors, such as machine wear and performance. For example, typical backing materials cause wear of mechanical components that secure the abrasive article. In particular, coated abrasive tapes and belts that advance through mechanical systems may wear shoes, back supports, and drums. Further, traditional backing materials may permit swarf and dislodged abrasive grains to become entrained between the backing and support components, causing wear.

To compensate for entrainment of swarf and grains, some manufacturers have turned to anti-static and hard surface coatings. However, such coatings often are difficult for a machine to secure, reducing machine performance. For example, such coated backings often lead to poor advancement of abrasive tape products through a machine or lead to bunching of tape in grind areas of the machine, each of which lead to down-time for repairs.

In order to secure the abrasive article to the tooling machine, backings are typically coated with anti-slip layers containing abrasive mineral fillers. Although the anti-slip layer increases the adhesion of the abrasive tape to the tooling machine, the traditional anti-slip layers and the abrasive mineral fillers result in tool wear. In particular, the abrasive mineral fillers can ultimately affect the life of the machine.

As such, an improved abrasive product including an improved backing material would be desirable.

SUMMARY

In a particular embodiment, an abrasive article includes a backing having first and second major surfaces, an abrasive layer disposed over the first major surface, and a back coat layer disposed over the second major surface. The back coat layer includes a polymeric material and a fabric.

In another embodiment, an abrasive article includes a backing having first and second major surfaces, an abrasive layer disposed over the first major surface, and a back coat layer disposed over the second major surface. The back coat layer includes a polymeric material and a fabric and has a Total Cut Parameter of not greater than about 0.020 grams.

In another embodiment, a method of forming an abrasive article includes providing a backing having first and second major surfaces. The backing includes a polyester film forming the first major surface and a back coat layer forming the second major surface. The back coat layer includes a fabric bonded to the polyester film by a polymeric material. The method further includes coating an abrasive layer to overlie the first major surface of the backing.

In yet another embodiment, a system for abrading a mechanical component includes payout and take-up spools, first and second rollers, and an abrasive tape. The abrasive tape extends from the payout spool, across the first and second rollers, around the mechanical component, to the take-up spool. The abrasive tape includes a backing having first and second major surfaces, an abrasive layer disposed over the first major surface, and a back coat layer disposed over the second major surface. The back coat layer includes a polymer and a fabric. The abrasive tape is positioned with the back coat layer facing towards the first and second rollers and the abrasive layer facing towards the mechanical component.

In still another embodiment, a method of abrading mechanical components includes locating a first portion of an abrasive tape in an abrading machine. The abrasive tape includes a backing having first and second major surface, an abrasive layer overlying the first major surface, and a back coat layer overlying the second major surface. The back coat layer includes a polymeric material and a fabric. The method further comprises rotating a first mechanical component in contact with the first portion of the abrasive tape, advancing the abrasive tape through the abrading machine to expose a second portion of the abrasive tape, and rotating a second mechanical component in contact with the second portion of the abrasive tape.

BRIEF DESCRIPTION OF THE DRAWINGS

The present disclosure may be better understood, and its numerous features and advantages made apparent to those skilled in the art by referencing the accompanying drawing.

DESCRIPTION OF THE DRAWINGS

In a particular embodiment, an abrasive article includes a backing having a first major surface and a second major surface. The abrasive article includes an abrasive layer overlying the first major surface. A back coat overlies the second major surface of the backing. In an exemplary embodiment, the back coat may be disposed directly on and directly contacts the second major surface of the backing without any intervening layers or tie layers. In another embodiment, the backing may be surface treated, chemically treated, primed, or any combination thereof. In particular, the back coat provides a desirable non-abrasive layer to the backing as well as provides an abrasive article with desirable frictional characteristics.

Figure 1:
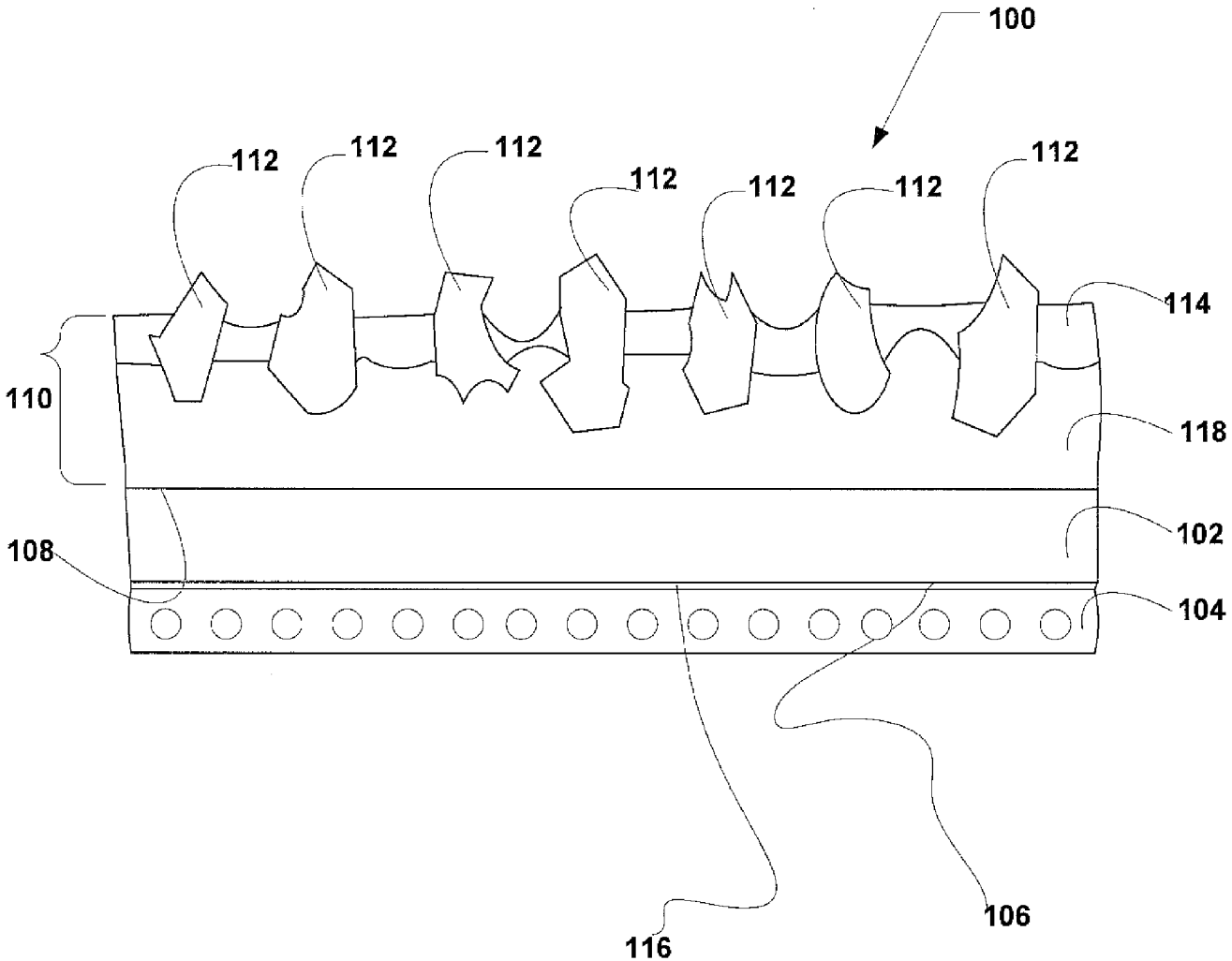
FIG. 1 includes an illustration of an exemplary abrasive article.

An exemplary embodiment of a coated abrasive article 100 is illustrated in FIG. 1. The coated abrasive includes a backing 102 and a back coat 104 disposed over the second major surface 106 of the backing 102. Disposed on the first major surface 108 of the backing 102 is an abrasive layer 110 in contact with abrasive grains 112. The abrasive layer 110, such as a make coat layer 118, is disposed over the first major surface 108 of the backing 102. Further, the coated abrasive 100 may include a size coat 114, a supersize coat (not illustrated) overlying the size coat 114, or an adhesion promoting layer (not illustrated) between the backing 102 and the make coat 110. In an exemplary embodiment, the coated abrasive can have a total thickness of 200 microns to 1000 microns.

The backing 102 of the abrasive article may be flexible or rigid and may be made of various materials. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yams comprising polyester, nylon, silk, cotton, poly-cotton, or rayon); paper; vulcanized paper; vulcanized rubber; vulcanized fiber; nonwoven materials; any combination thereof; or any treated version thereof. Cloth backings may be woven or stitch bonded. In particular examples, the backing is selected from the group consisting of paper, polymer film, cloth, cotton, poly-cotton, rayon, polyester, poly-nylon, vulcanized rubber, vulcanized fiber, metal foil or any combination thereof. For example, the backing can include paper, a polymer film, a polymer foam, a foil, or any combination thereof. In an exemplary embodiment, the backing includes a thermoplastic film, such as a polyethylene terephthalate (PET) film. In particular, the backing may be a single layer polymer film, such as a single layer PET film. An exemplary rigid backing includes a metal plate, a ceramic plate, or the like.

Typically, the backing 102 has a thickness of at least about 50 microns, such as greater than about 75 microns. For example, the backing 102 may have a thickness of greater than about 75 microns and not greater than about 200 microns, or greater than about 75 microns and not greater than about 150 microns.

In an exemplary embodiment, the back coat layer 104 includes a polymeric material and a fabric. In an example, the back coat layer 104 can have a thickness of 25 microns to 100 microns. The fabric can include natural fibers, synthetic fibers, such as polyester fibers, nylon fibers, or other suitable synthetic fibers, or any combination thereof. Additionally, the fabric can be a woven fabric, a nonwoven fabric, or any combination thereof. For example, the fabric can be a woven fabric, such as a scrim. A nonwoven fabric can include an intermeshing of randomly oriented fibrous strands.

In an example, the fabric has a weight in a range of 0.1 ounces per square yard (osy) (3.4 g/m$^2$) to 3 osy (103 g/m$^2$), such as 0.2 osy (6.8 g/m$^2$) to 2 osy (68.7 g/m$^2$), or even 0.2 osy (6.8 g/m$^2$) to 1.0 osy (34.4 g/m$^2$). In a further example, the fabric can include threads having a diameter in a range of 0.0001 mm to 5 mm, such as a range of 0.0005 mm to 1 mm, a range of 0.001 mm to 0.02 mm, or even a range of 0.0005 mm to 0.015 mm. In an additional example, the fabric can have a thickness of not greater than 75 microns, such as from 13 microns to 50 microns.

In a particular embodiment, the fabric is a woven fabric having not greater than 50 threads per inch. For example, the fabric may have 3 threads per inch (tpi) to 50 tpi, such as 3 tpi to 40 tpi, 3 tpi to 30 tpi, or even 5 tpi to 15 tpi in the warp or weft directions.

In another exemplary embodiment, the fabric can be a non-woven fabric or randomly oriented fibers. In an example, the fabric prior to attachment as part of the back coat layer 104 has a grab strength (determined in accordance with ASTM D5034) in a range of 5 lbs. to 90 lbs, such as a range of 5 lbs to 50 lbs, a range of 5 lbs to 30 lbs, or even a range of 5 lbs to 20 lbs. In addition, the fabric can have a trapezoidal tear strength (determined in accordance with ASTM D5733) in a range of 3 lbs to 15 lbs in the machine direction or 5 lbs to 25 lbs in the transverse direction. The fabric can have a pre-laminate thickness in a range of 0.005 mm to 0.5 mm, such as a range of 0.005 mm to 0.25 mm, a range of 0.005 mm to 0.15 mm, or even a range of 0.013 mm to 0.05 mm. In a particular example, the non-woven fabric is formed by spinning and autogenously bonding continuous filaments of a polymer into a flat fabric. In an example, the filaments can have a diameter of 0.5 microns to 15 microns. An exemplary fabric is available under the tradename Cerex® available from Cerex Advanced Fabrics, Inc.

In an embodiment, the polymeric material can include a thermoplastic polymer, a thermoset polymer, a polymer derived from an adhesive, or any combination thereof. The adhesive can be a solvent based adhesive, including a solvent such as water, an organic solvent, or any combination thereof. The thermoplastic polymer can include an olefinic polymer, a thermoplastic polyurethane, a thermoplastic polyolefin, a thermoplastic vulcanite, a functionalized copolymer, or any combination thereof. In an example, the thermoset polymer can include an epoxy resin or a phenolic resin, such as a resole resin or a novolac resin.

In an exemplary embodiment, the back coat layer 104 may include an olefinic polymer. Herein, olefinic polymer includes a homopolymer or a copolymer formed from at least one alkylene monomer. For example, an olefinic polymer may include a polyolefin or a diene elastomer. An example of the olefinic polymer includes a polyolefin homopolymer, such as polyethylene, polypropylene, polybutene, polypentene, polystyrene, or polymethylpentene; a polyolefin copolymer, such as a modified styrene copolymer, ethylene-propylene copolymer, ethylene-butene copolymer, or ethylene-octene copolymer; a diene elastomer, such as an ethylene propylene diene monomer (EPDM) elastomer; a thermoplastic olefin (TPO); or any blend or combination thereof. In a particular example, the olefinic polymer includes a thermoplastic olefin (TPO). An exemplary polyethylene includes high density polyethylene (HDPE), medium density polyethylene (MDPE), low density polyethylene (LDPE), ultra low density polyethylene, or any combination thereof.

In a particular example, the polymeric material includes a thermoplastic vulcanate, such as a blend of a diene elastomer and a polyolefin. The polyolefin of the blend may include a homopolymer, a copolymer, a terpolymer, an alloy, or any combination thereof formed from a monomer, such as ethylene, propylene, butene, pentene, methyl pentene, octene, or any combination thereof. An exemplary polyolefin includes high density polyethylene (HDPE), medium density polyethylene (MDPE), low density polyethylene (LDPE), ultra low density polyethylene, ethylene propylene copolymer, ethylene butene copolymer, polypropylene (PP), polybutene, polypentene, polymethylpentene, polystyrene, ethylene propylene rubber (EPR), ethylene octene copolymer, or any combination thereof. In a particular example, the polyolefin includes high density polyethylene. In another example, the polyolefin includes polypropylene. In a further example, the polyolefin includes ethylene octene copolymer. In a particular embodiment, the polyolefin is not a modified polyolefin, such as a carboxylic functional group modified polyolefin, and in particular, is not ethylene vinyl acetate. In addition, the polyolefin is not formed from a diene monomer. An exemplary commercially available polyolefin includes Equistar 8540, an ethylene octene copolymer; Equistar GA-502-024, an LLDPE; Dow DMDA-8904NT 7, an HDPE; Basell Pro-Fax SR275M, a random polypropylene copolymer; Dow 7C50, a block PP copolymer; or products formerly sold under the tradename Engage by Dupont Dow. Another exemplary resin includes Exxon Mobil Exact 0201 or Dow Versify 2300.

In an example, the back coat layer 104 includes thermoplastic polyurethanes. Thermoplastic polyurethanes are the formed from at least one polyol and at least polyisocyanate. Polyols include, for example, polyethers and polyesters. Polyisocyanates may be aliphatic or aromatic. Thermoplastic polyurethanes include, for example, polyether based polyurethanes, polyester based polyurethanes, polyether/polyester hybrid polyurethanes, or any combination thereof. Exemplary commercially available thermoplastic polyurethanes include Bayer Desmopan and GLS Versollan.

In an example, the back coat layer 104 includes functionalized copolymers. Functionalized copolymers, as used herein, include a polymer having functional groups that include elements such as halogen, oxygen, nitrogen, sulfur, or phosphorus. Examples of functionalized copolymers can include functionalized ethylene vinyl acetate, functionalized ethylene acrylate, functionalized polyethylene, maleic anhydride grafted polypropylene, or any combination thereof.

In an example, the thermoset polymer can include an epoxy resin, a urea-formaldehyde resin, a melamine resin, a polycyanurate resin, or a phenol-formaldehyde resin, such as a resole resin or a novolac resin. In a particular example, the thermoset polymer includes an epoxy resin. In another example, the thermoset polymer includes a phenol-formaldehyde resin.

The back coat layer 104 may also include optional components, such as soft fillers. Soft fillers include materials such as talc, graphite, and any combination thereof. In an exemplary embodiment, the material of back coat layer 104 may include a crosslinking agent, a photoinitiator, a thermal initiator, a filler, a pigment, an antioxidant, a flame retardant, a plasticizer, or any combination thereof. Alternatively, the layers 104 may be free of crosslinking agents, photoinitiators, thermal initiators, fillers, pigments, antioxidants, flame retardants, or plasticizers. In particular, the layer 104 may be free of photoinitiators or crosslinking agents. Further, the back coat layer 104 may be free of abrasive particulate.

In an exemplary embodiment, the polymeric material of the back coat layer 104 is thermoplastic and is polymerized prior to application on the backing 102. In an exemplary embodiment, the thermoplastic material of the back coat layer 104 is fully polymerized and does not further cure after coating. Alternatively, the material of the back coat layer 104 may be cured through cross-linking. In a particular example, the back coat layer 104 may be crosslinkable through radiation, such as using x-ray radiation, gamma radiation, ultraviolet electromagnetic radiation, visible light radiation, electron beam (e-beam) radiation, or any combination thereof. Ultraviolet (UV) radiation may include radiation at a wavelength or a plurality of wavelengths in the range of from 170 nm to 400 nm, such as in the range of 170 nm to 220 nm. Ionizing radiation includes high-energy radiation capable of generating ions and includes electron beam (e-beam) radiation, gamma radiation, and x-ray radiation. In a particular example, e-bearn ionizing radiation includes an electron beam generated by a Van de Graaff generator or an electron-accelerator. In an alternative embodiment, the back coat layer 104 may be cured through thermal methods.

In a particular embodiment, the back coat layer 104 is bonded directly to and directly contacts the backing 102. For example, the back coat layer 104 may be directly bonded to and directly contact the backing 102 without an intervening adhesion enhancement layer. In an embodiment, the backing 102 may be treated to increase the adhesion between the backing 102 and the back coat layer 104. Treatment may include surface treatment, chemical treatment, use of a primer, or any combination thereof. In an exemplary embodiment, the treatment may include corona treatment, UV treatment, electron beam treatment, flame treatment, scuffing, or any combination thereof. As illustrated, an optional adhesion enhancement layer 116 may be formed to underlie back coat layer 104 to improve adhesion between the back coat layer 104 and the backing 102. In particular, the optional adhesion enhancement layer 116 may be disposed between the backing 102 and the back coat layer 104. An exemplary primer used as the optional adhesion enhancement layer 116 may include a chemical primer that increases the adhesion between the backing 102 and the back coat layer 104. An exemplary chemical primer is a polyethylene imine primer. In an embodiment, the optional adhesion enhancement layer 116 is a copolymer including at least one ethylene monomer and at least one monomer of acrylic acid, ethyl acrylic acid, or methyl acrylic acid. Typically, the optional adhesion enhancement layer 116 has a thickness of not greater than about 5 microns, such as not greater than about 3 microns, such as not greater than about 2.5 microns.

In a further example, the back coat layer 104 secures the fabric in a manner that provides a low thickness. The fabric can provide a non-slip surface for the abrasive article without providing a means for attachment of the abrasive article. The filaments are substantially bounded as part of the back coat layer 104 to limit formation of loops or bristles extending from the back surface of the abrasive article 100. For example, at least about 90% of the filaments can be fully bonded the polymeric material. As such, the back surface of the abrasive article 100 is substantially free of loops and bristles extending from the back surface. In an embodiment, the fabric can be calendared or flattened, and may be melt-fused, to provide a low thickness.

The back coat layer 104 can be compatible with cooling fluids. For example, the back coat layer 104 may not disintegrate, dissolve, or delaminate in the presence of the cooling fluid. In an example, the back coat layer 104 may be compatible with cooling fluids, such as deionized water, mineral oil-based cooling fluids, or Syntilo or Honilo products by Castrol, or other suitable cooling fluids.

The abrasive article 100 further includes an abrasive layer 110 overlying the first major surface 108 of the backing 102. In an exemplary embodiment, the abrasive layer 110 may directly contact the first major surface 108 of the backing 102 without any intervening layers or tie layers between the first major surface of the backing and the abrasive layer. In another embodiment, the backing 102 on the first major surface 108 may be surface treated, chemically treated, primed, or any combination thereof to increase the adhesion between the backing 102 and the abrasive layer 110. In particular, the abrasive layer 110 may include an adhesion promoting layer (not illustrated) between the backing 102 and the make coat layer 118. The abrasive layer 110 may be formed as one or more coats. Generally, the abrasive layer 110 is formed of a binder or make coat layer 118, and abrasive grains 112 that overlie the first major surface 108 of the backing 102. In an exemplary embodiment, the abrasive grains 112 are blended with a binder formulation to form abrasive slurry that is used to form the abrasive layer 110. Alternatively, the abrasive grains 112 are applied over the binder formulation after the binder formulation is coated over the first major surface 108 of the backing 102 to form the make coat layer 118. In addition, a size coat 114 may be applied over the make coat layer 118 and the abrasive grains 112.

Particular coated abrasives include engineered or structured abrasives that generally include patterns of abrasive structures. Optionally, a functional powder may be applied over the abrasive layer 110 to prevent the abrasive layer 110 from sticking to a patterning tooling. Alternatively, patterns may be formed in the abrasive layer 108 absent the functional powder.

In an example, a binder may be formed of a single polymer or a blend of polymers. The binder can be used to form a make coat 118, a size coat 114, a supersize coat, or any combination thereof. For example, the binder may be formed from epoxy, phenolic resin, acrylic polymer, or a combination thereof. In addition, the binder may include filler, such as nano-sized filler or a combination of nano-sized filler and micron-sized filler. In a particular embodiment, the binder includes a colloidal binder, wherein the formulation that is cured to form the binder is a colloidal suspension including particulate filler. Alternatively, or in addition, the binder may be a nanocomposite binder or coating material including sub-micron particulate filler.

The binder generally includes a polymer matrix, which binds the abrasive grains 112 to the abrasive layer 110. Typically, the binder is formed of cured binder formulation. For the preparation of the polymer component, the binder formulation may include one or more reaction constituents or polymer constituents. A polymer constituent may include a monomeric molecule, an oligomeric molecule, a polymeric molecule, or a combination thereof. The polymer constituents can form thermoplastics or thermosets. The binder formulation may further include components such as dispersed filler, solvents, plasticizers, chain transfer agents, catalysts, stabilizers, dispersants, curing agents, reaction mediators, or agents for influencing the fluidity of the dispersion. In addition to the above constituents, other components may also be added to the binder formulation, including, for example, antistatic agents, such as graphite, carbon black, and the like; suspending agents, such as fumed silica; anti-loading agents, such as zinc stearate; lubricants such as wax; wetting agents; dyes; fillers; viscosity modifiers; dispersants; defoamers; or any combination thereof.

To form an abrasive layer, abrasive grains may be included within the binder or deposited over the binder. The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, or any combination thereof. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, or a blend thereof. In a further example, the abrasive grain may be formed of an agglomerated grain. Particular embodiments have been created by use of dense abrasive grains comprised principally of alpha-alumina.

The abrasive grains may also have a particular shape. An example of such a shape includes a rod, a triangle, a pyramid, a cone, a solid sphere, a hollow sphere, or any combination thereof. Alternatively, the abrasive grains may be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size may be at least 0.1 microns, such as from about 0.1 microns to about 1500 microns, and more typically from about 0.1 microns to about 200 microns, or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In a blended abrasive slurry including the abrasive grains and the binder formulation, the abrasive grains provide from about 10.0% to about 90.0%, such as from about 30.0% to about 80.0%, of the weight of the abrasive slurry.

The abrasive slurry further may include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment of grinding aid includes cryolite and potassium tetrafluoroborate with particle size ranging from 1 micron to 80 microns, and most typically from 5 microns to 30 microns. The weight percent of grinding aid is generally not greater than about 50.0 wt %, such as from about 0.0 wt % to 50.0 wt %, and most typically from about 10.0 wt % to 30.0 wt % of the entire slurry (including the abrasive grains).

Figure 2:
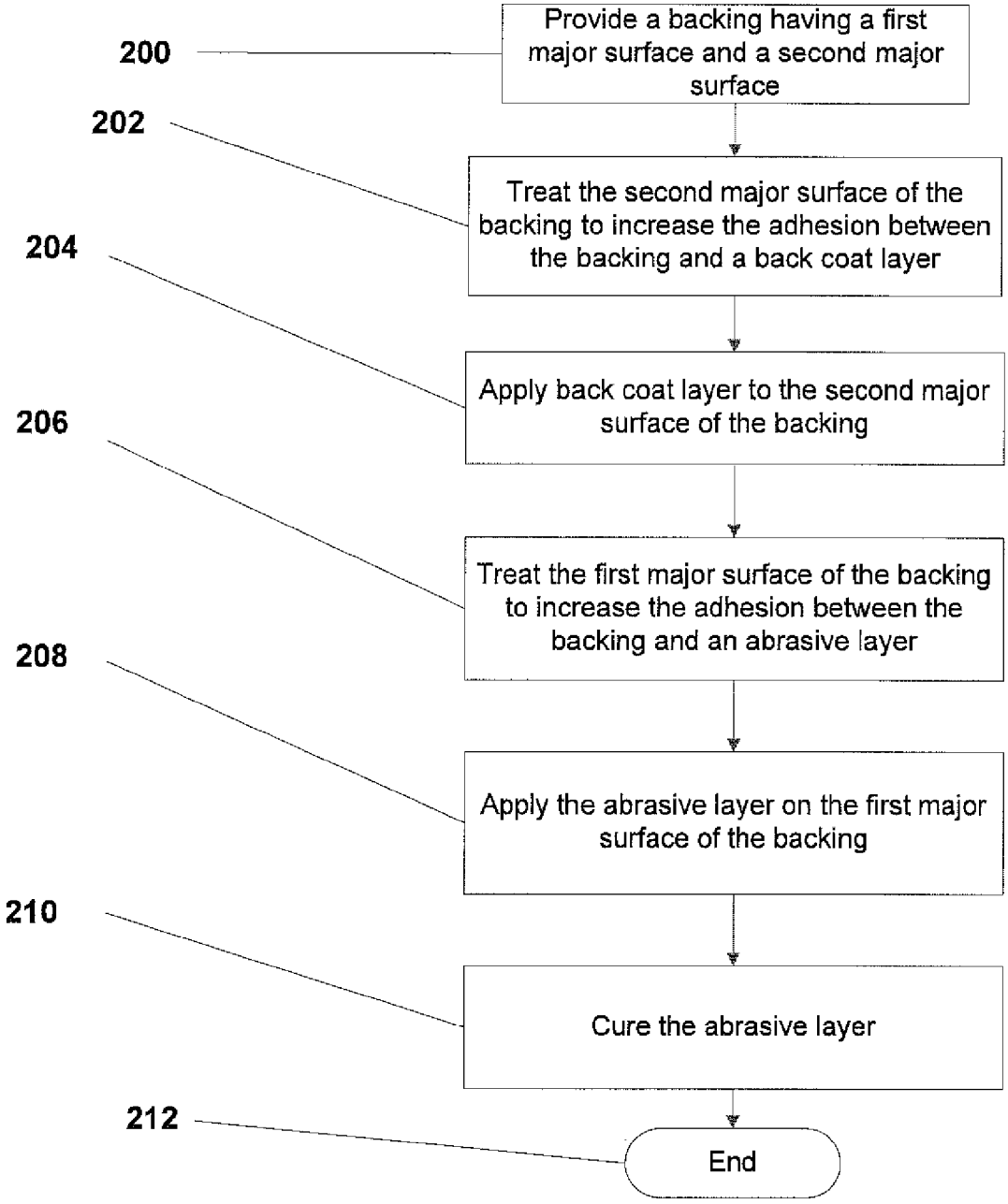
FIG. 2 is a flow chart illustrating a method of forming an abrasive article.

Referring to FIG. 2, an exemplary, non-limiting embodiment of a method of forming an abrasive article is shown and commences at block 200. At block 200, a backing is provided having a first and second major surface. Optionally, as seen at block 202, the second major surface 106 of the backing 102 may be treated to increase the adhesion between the back coat layer 104 and the backing 102. In an embodiment, treatment includes forming an optional adhesion enhancement layer 116.

As seen at block 204, the back coat layer 104 is then coated onto the backing 102. Coating may include extrusion coating, emulsion coating, or solution coating. In an exemplary process, the polymeric material that is extrusion coated onto the backing 102 and the fabric applied onto the extrusion coated polymeric material. In another exemplary process, the fabric can be coated with the polymeric material to form the back coat layer 104 which can be laminated to the backing 102. In yet another exemplary embodiment, the polymeric material film and the fabric can be laminated to the backing 102 substantially simultaneously to form the back coat layer. Once coated on the backing, the polymeric material back coat layer 104 may be completely cured or may be at least partially cured and cured to completion at a later time. In an embodiment, the back coat layer 104 is fully polymerized prior to coating and does not need further cure after coating.

The method of forming an abrasive article further includes applying an abrasive layer 110 to the backing 102. As seen at block 206, the backing 102 on the first major surface 108 may be treated to increase the adhesion between the backing 102 and the abrasive layer 110. In particular, the abrasive layer 110 may include an adhesion promoting layer (not illustrated) between the backing 102 and the abrasive layer 110.

As seen in block 208, the abrasive layer 110 may be applied on the first major surface 108 of the backing 102. In an exemplary embodiment, the binder formulation may be disposed on the first major surface 108 of the backing 102 as a make coat 118. In an exemplary process for forming the abrasive layer 110, the binder formulation is coated on the backing 102, abrasive grains 112 are applied over the make coat 118, and the make coat 118 is at least partially cured, as seen at block 210. The abrasive grains 112 may be provided following coating of the backing 102 with the binder formulation, after partial curing of the binder formulation, after patterning of the binder formulation, or after fully curing the binder formulation. The abrasive grains 112 may, for example, be applied by a technique, such as electrostatic coating, drop coating or mechanical projection. In another exemplary embodiment, the binder formulation is blended with the abrasive grains 112 to form abrasive slurry that is coated on the backing 102, at least partially cured and optionally patterned.

Once the abrasive layer is cured, an abrasive article is formed. Alternatively, a size coat 114 may be applied over the abrasive layer 110. In an embodiment, a size coat 114 may be applied over the binder formulation and abrasive grains. For example, the size coat 114 may be applied before partially curing the binder formulation, after partially curing the binder formulation, after patterning the binder formulation, or after further curing the binder formulation. The size coat 114 may be applied by, for example, roll coating or spray coating. Depending on the composition of the size coat 114 and when it is applied, the size coat 114 may be cured in conjunction with the binder formulation or cured separately. A supersize coat including grinding aids may be applied over the size coat and cured with the binder formulation, cured with the size coat, or cured separately. The method can end at state 212.

The abrasive articles may be formed into an abrasive strip, ribbon, or tape. In a particular example, the abrasive article is in the form of a tape or ribbon having length, widths, and thickness dimensions. The abrasive article can have an aspect ratio of at least about 10, such as at least about 20, even at least about 100. As used herein, the aspect ratio is defined as the ratio of the longest dimension to the second longest dimension, such as the length and width of the abrasive article. Alternatively, the abrasive article can be formed into a sheet or disk.

Figure 3:
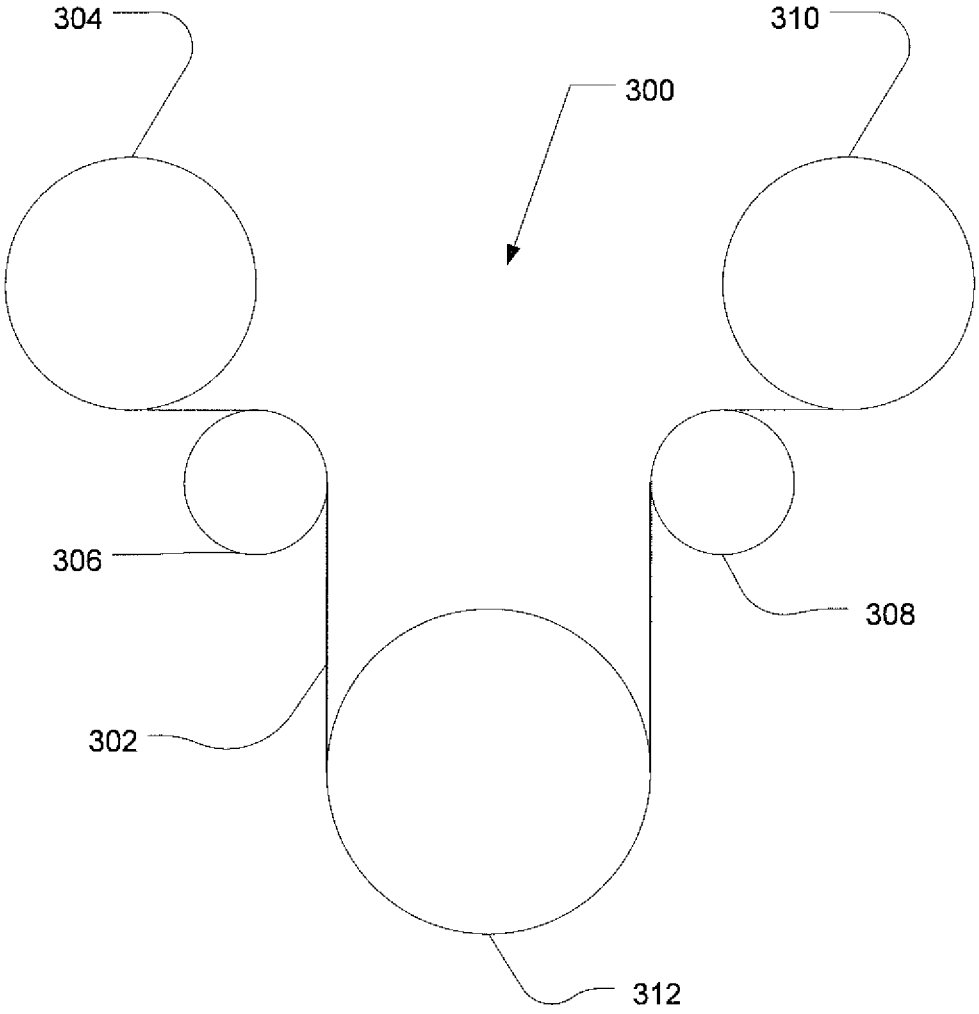
FIG. 3 in an illustration of exemplary abrading system.

In a particular embodiment, the abrasive tape is used to abrade mechanical components. Referring to FIG. 3, an exemplary, non-limiting embodiment of crankshaft grinding equipment is shown and is generally designated 300. Typically, the abrasive tape 302 can be supplied by a payout spool 304. The abrasive tape 302 can be placed across rollers 306 and 308. The rollers 306 and 308 can control the tension on the abrasive tape 302 and can be used to guide the abrasive tape 302. Optionally, the abrasive tape 302 can be guided or pressed against an article to being abraded with one or more shoes or supports (not illustrated). Such rollers, shoes, or supports can be formed of india stone, diamond coated steel, polyurethane, or other materials. The abrasive tape 302 can be feed onto take-up spool 310. The abrasive tape 302 can be placed in contact with the mechanical component, such as a camshaft 312, and the component can be rotated. As the abrasive tape is worn and ground on the mechanical components, more abrasive tape can be advanced to provide further abrasion.

Figure 4:
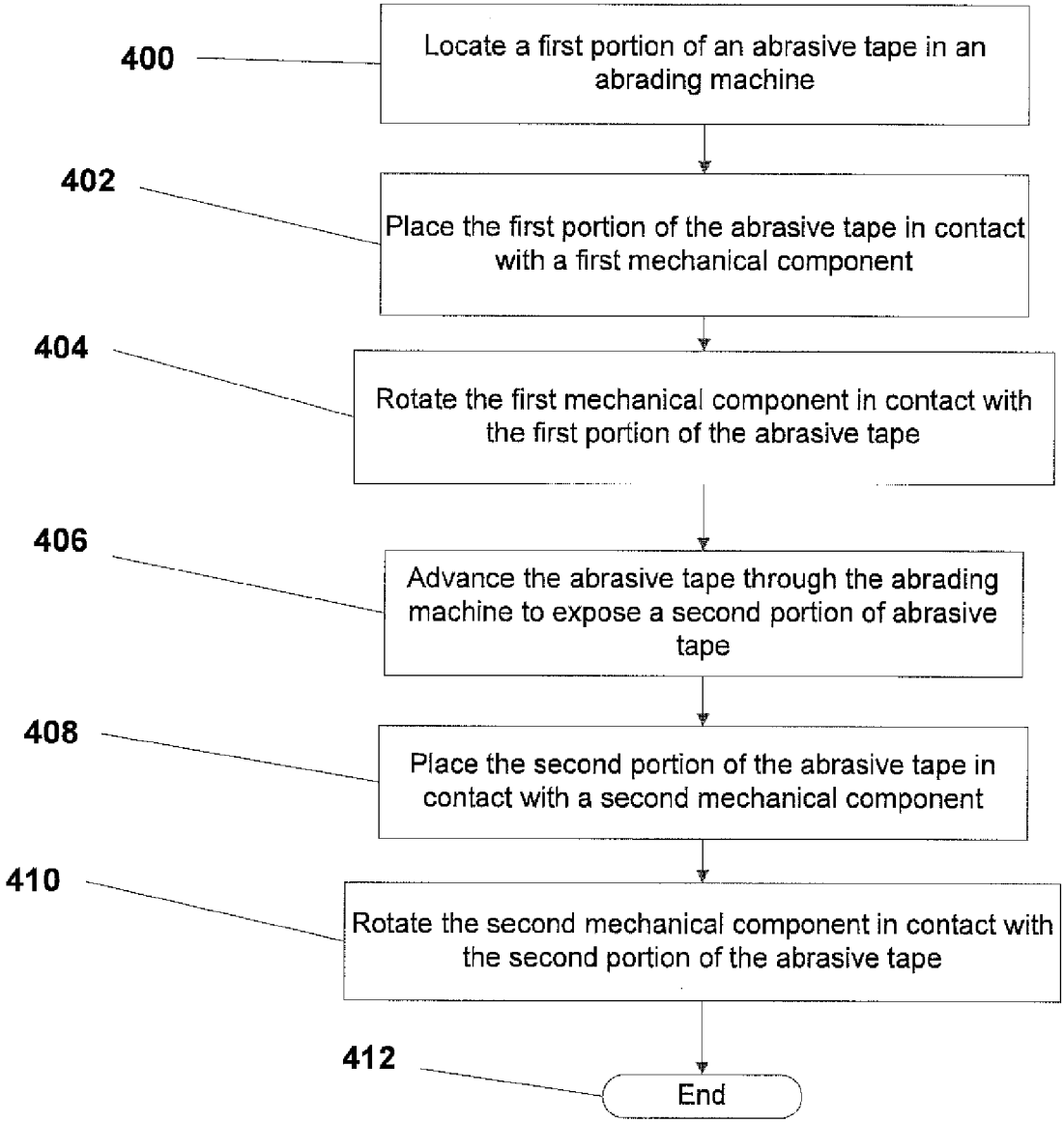
FIG. 4 is a flow chart illustration of a method of abrading mechanical components.

An exemplary method for abrading mechanical components can be seen in FIG. 4 and commences at block 400. At block 400, the method of abrading mechanical components includes placing a first portion of the abrasive tape in the abrading machine. Typically, at block 402, the abrasive tape is placed in contact with a first mechanical component. At block 404, the first mechanical component is then rotated to abrade the first mechanical component. At block 406, a second portion of the abrasive tape may then be advanced through the abrading machine. At block 408, the second portion of the abrasive tape is placed in contact with a second mechanical component. At block 410, the second mechanical component may then be rotated while in contact with the second portion of the abrasive tape. The method can end at state 412.

Particular embodiments of the above abrasive articles and method advantageously provide improved performance. Such embodiments advantageously reduce wear of abrading equipment. For example, when used in the form of an abrasive ribbon, strip, or tape, such embodiments reduce wear on drums, shoes, and back supports. Additionally, embodiments of such tapes exhibit reduced slippage against the abrading equipment. Further, embodiments of such tapes more easily advance through abrading machines without bunching and with reduced wear. In particular, the combination of layers having the disclosed polymeric layer may advantageously produce abrasive articles having desirable mechanical properties and desirable performance properties.

In an exemplary embodiment, the abrasive article advantageously provides an improved Total Cut Parameter, which is indicative of the abrasive nature of the backing against tooling. In contrast to a desirably higher material removal rate of the abrasive on an abraded product, a relatively lower material removal rate is desired on the tooling supporting the abrasive. The Total Cut Parameter is defined as the total cut (in grams) of the back side of the abrasive article over an acrylic sheet as determined in accordance with the method of Example 3 below. For instance, the Total Cut Parameter of the abrasive article against an acrylic panel may be not greater than about 0.020 grams, such as not greater than about 0.010 grams, such as not greater than about 0.005 grams, even not greater than about 0.0025 grams.

In an embodiment, the abrasive article may also provide an advantageous coefficient of friction when tested under wet conditions. For instance, when wet tested in mineral seed oil under a total normal force of 1300 grams as described below, the dynamic coefficient of friction is at least about 0.50, such as at least 0.55, at least 0.65, or even at least 0.7. In an embodiment, when wet tested in a water-based coolant under a total normal force of 1300 grams as described below, the dynamic coefficient of friction is at least about 0.55, such as at least 0.6, at least 0.65, or even at least 0.7.

EXAMPLES

Example 1

Samples are prepared by adhering a variety of fabrics to abraded polyester films. The fabric is selected from scrims KPMR6420/F14, 0002/287, and 0005/287, available from Saint-Gobain Technical Fabrics (SGTF) or CEREX® nylon non-woven fabrics, available from Cerex Advanced Fabrics, Inc.

Figure 5:
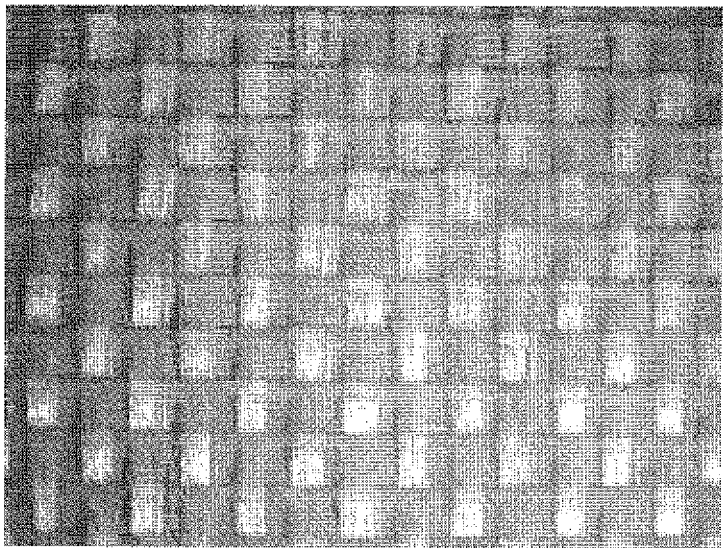
FIG. 5, FIG. 6, FIG. 7, FIG. 8, FIG. 9, and FIG. 10 include illustrations of exemplary articles.
Figure 6:
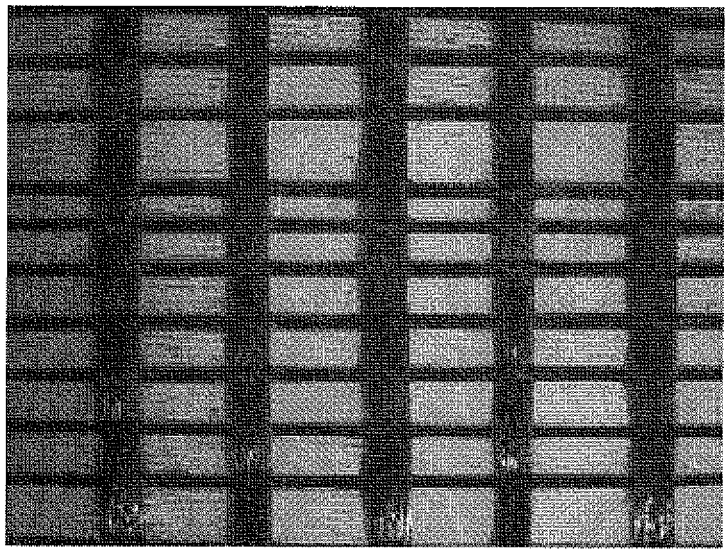
Figure 7:
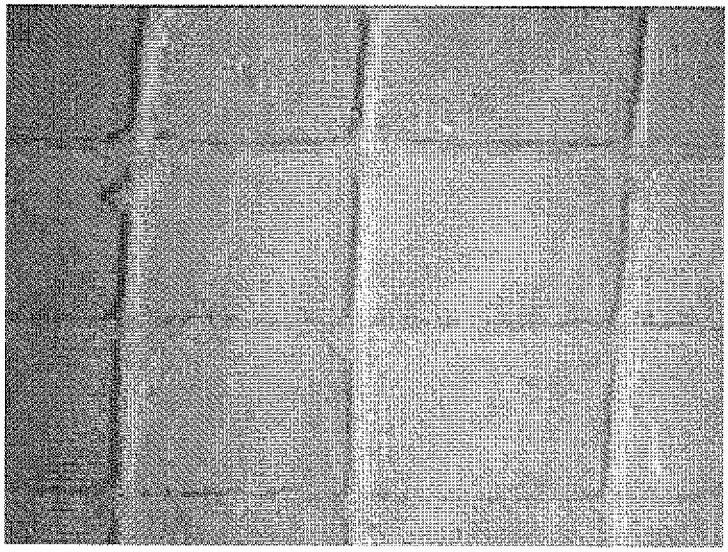

For samples including the scrims available from Saint-Gobain Technical Fabrics, an adhesive resin (Bostik solvent-based linear saturated polyester) and 2.5% curative (Bascodur 21) are coated at a rate of 5 to 10 grams per square meter (gsm) with a #8 Meyer rod. The scrim fabrics are wet laminated to the adhesive and the adhesive is cured for at least 4 hours at 150° F. FIG. 5 includes an illustration of the sample including SGTF Fabric 0002/287, FIG. 6 includes an image of the sample including SGTF Fabric 0005/287, and FIG. 7 includes an image of the sample including SGTF KPMR6420/F14.

Figure 8:
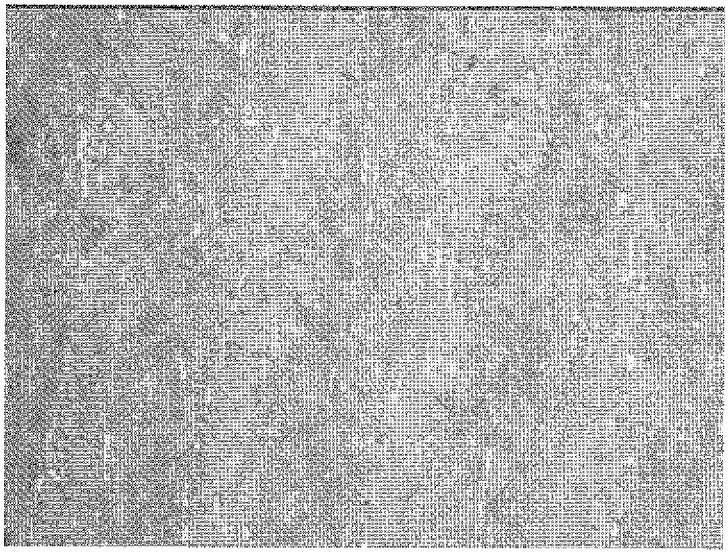

Non-woven samples are prepared by applying an adhesive resin (Vitel 3300) and 2.9% curative (Bascodur 21), laying the fabric on the adhesive resin, and applying a second coat of adhesive to a total adhesive weight of about 10 gsm to 20 gsm. Samples are prepared using fabrics of weight 0.3 osy, 0.4 osy, 0.5 osy, 0.7 osy and 0.85 osy. FIG. 8 includes an image of the sample including 0.3 osy non-woven fabric.

Figure 9:
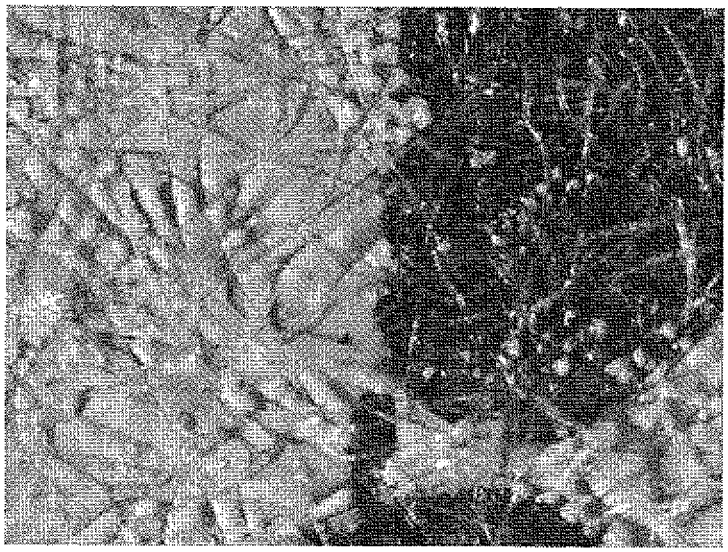
Figure 10:
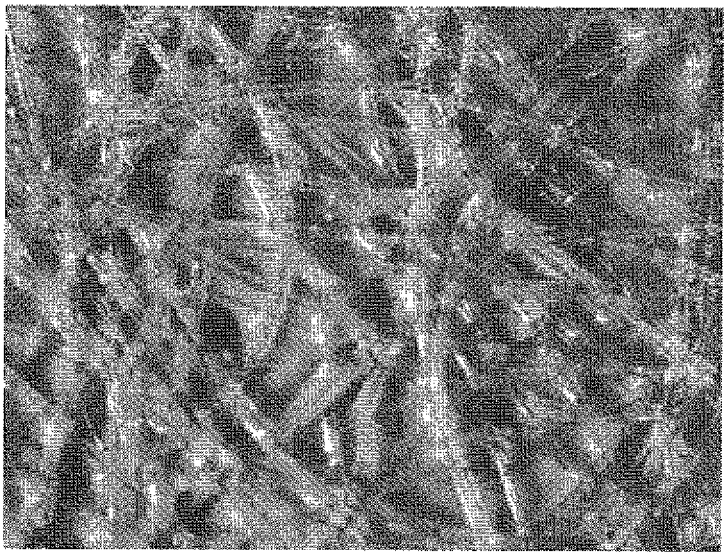

Additional samples are prepared by extrusion coating polyolefin on a back surface of a polyester film. Fabric is heat laminated to the coated backside of the film. A sample illustrated in FIG. 9 includes low density polyethylene (LDPE) and 0.5 osy CEREX® non-woven fabric heat laminated to the LDPE at 350° F. A sample illustrated in FIG. 10 includes maleic anhydride functionalized polypropylene (MAPP) and 0.5 osy CEREX® non-woven fabric heat laminated to the MAPP at 375F.

In each of the samples, the filaments of the fabric are bound to the surface without extending to form loops or bristles.

Example 2

The coefficient of friction test is performed according to ASTM D1894-01 on a TMI Monitor/Slip and Friction tester, Model No. 32-06. A 200 gram sled has 1100 grams of added weight for a total normal force of 1300 grams with a feed rate of 150 mm/minute. The test substrate was a 2 inch by 6 inch PSTC stainless steel panel. The friction coefficient is tested under wet conditions using a water based coolant (Multan 5500 WB commercially available from Henkel AG) or a mineral seal oil based coolant (Mineral Seal Oil 600, Lubricants USA, Plano, Tex.). Results are illustrated in Tables 1.

Comparative Sample 1 is a commercially available abrasive strip (372L film commercially available from 3M). The strip includes a 40 micron aluminum oxide abrasive grain bonded to a 5 mil polyester film. The back side layer consists of a friction grip coating.

Comparative Sample 2 is a 5 mil PET film coated with water based UV cured polyurethane (Neorad 3709) with fused silica filler (Minsil 20).

Comparative Sample 3 is an abrasive strip including a 40 micron aluminum oxide abrasive grain bonded to a 5 mil polyester film. The back side layer consists of an extruded polymer. (Q351)

Sample 1 is prepared as Comparative Sample 3 with the addition of a nylon nonwoven fabric having a weight of 0.3 OSY (10 g/m$^2$) (commercially available from Cerex Advanced Fabrics, Inc., Cantonment, Fla.). The fabric is laminated to the back side of the abrasive strip after the polymer is applied.

Sample 2 is prepared as Sample 1, except a polyester nonwoven fabric having a weight of 1.0 OSY Hollytex (34 g/m$^2$) (Commercially available from Ahlstrom, Green Bay, Wis.).

TABLE 1

Dynamic COF, Wet Test in Mineral Seal Oil.

| | Friction coefficient |
|---|---|
| Comparative Sample 1 | 0.67 |
| Comparative Sample 2 | 0.54 |

TABLE 1-continued

Dynamic COF, Wet Test in Mineral Seal Oil.

| | Friction coefficient |
|---|---|
| Comparative Sample 3 | 0.49 |
| Sample 1 | 0.74 |
| Sample 2 | 0.73 |

TABLE 2

Dynamic COF, Wet Test in Multan WB.

| Polymeric layer, thickness, width × length | Friction coefficient |
|---|---|
| Comparative Sample 1 | 0.76 |
| Comparative Sample 2 | 0.56 |
| Comparative Sample 3 | 0.51 |
| Sample 1 | 0.66 |
| Sample 2 | 0.80 |

Overall, the polyester nonwoven fabric provides an increased coefficient of friction in both water based and oil based coolants.

Example 3

The abrasiveness of the samples are tested against an acrylic panel. The test method and conditions are as follows:

TABLE 12

Test Conditions

| Parameter | Setting |
|---|---|
| Coated Abrasive Speed | 43.5 feet per minute |
| Backup Pad | 80 Durometer (Shore A) Garlock #7797 Rubber Pad (1" × 1.5") |
| Tension | None |
| Grinding Aid | Water (On Automatic) |
| Test Piece | McMaster Carr Part # 8560K513, cast acrylic (panels 3/16" × 12" × 24") cut to 5-7/8" × 1-15/16" |
| Test Piece Pressure | 644 Gram deadweight each side |
| Test Piece Speed | 0 |
| Time Intervals | 400 Strokes |
| Measurements Recorded | GRAMS CUT |
| Contact Angle | 0 Degrees (full face) |
| Air | Off |
| Product Soak | Dipped in water prior to test |

Sample preparation includes cutting the acrylic panels to the size listed above. The procedure includes the following steps:

Sand test panel according to parameters above

Remove the test pieces and thoroughly dry using precision wipe towels. Allow 1 minute to air dry.

Weigh the test pieces and record the final panel weight. Calculate the MRR (cut) of the product.

Exemplary total cut values are illustrated in Table 13.

TABLE 13

Total Cut Values

| Sample | Total Cut (grams) |
|---|---|
| Comparative Sample 1 | 0.2710 |
| Comparative Sample 2 | 0.0700 |
| Comparative Sample 3 | 0.0190 |

TABLE 13-continued

| Total Cut Values | |
|---|---|
| Sample | Total Cut (grams) |
| Sample 1 | 0.0025 |
| Sample 2 | to small to measure |

Overall, the samples having a backcoat including a fabric and a polymer have a much lower cut.

The total cut measured in accordance with the method described above is the referred to herein as the Total Cut Parameter. The Total Cut Parameter of the PET backing with the polymeric and fabric layer is lower and hence, less abrasive to the tooling machine supporting the abrasive article than the standard control film.

The above-disclosed subject matter is to be considered illustrative, and not restrictive, and the appended claims are intended to cover all such modifications, enhancements, and other embodiments, which fall within the true scope of the present invention.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article comprising:

a backing including first and second major surfaces;

an abrasive layer disposed over the first major surface; and a back coat layer disposed over the second major surface, the back coat layer including a polymeric material and a fabric, wherein the abrasive article has a total thickness of between about 200 microns to about 1000 microns.

2. The abrasive article of claim 1, wherein the back coat layer is substantially free of loops and bristles extending from the back coat layer.

3. The abrasive article of claim 1, wherein the fabric includes a woven fabric.

4. The abrasive article of claim 3, wherein the woven fabric includes a scrim.

5. The abrasive article of claim 1, wherein the fabric includes a non-woven fabric.

6. The abrasive article of claim 1, wherein the fabric has a fabric weight of 0.1 osy to 3 osy.

7. The abrasive article of claim 1, wherein the back coat layer directly contacts the second major surface of the backing film without intervening layers.

8. The abrasive article of claim 1, wherein the polymeric material is a thermoplastic polymer.

9. The abrasive article of claim 8, wherein the thermoplastic polymer is an extrusion coated polymer.

10. The abrasive article of claim 1, wherein the backing includes a polymer film.

11. The abrasive article of claim 1, wherein the abrasive article has an aspect ratio of at least about 10.

12. The abrasive article of claim 1, wherein the back coat layer has a thickness of about 25 microns to about 100 microns.

13. The abrasive article of claim 1, wherein the back coat layer is free of abrasive particulate.

14. The abrasive article of claim 1, wherein the backcoat layer has a Total Cut Parameter of not greater than about 0.020 grams.

15. The abrasive article of claim 1, having a wet (mineral oil) dynamic coefficient of friction greater than about 0.50.

16. A method of forming an abrasive article, the method comprising:

providing a backing having first and second major surfaces, the backing including a polyester film forming the first major surface and a back coat layer forming the second major surface, the back coat layer including a fabric bonded to the polyester film by a polymeric material; and coating an abrasive layer to overlie the first major surface of the backing, wherein the abrasive article has a total thickness of between about 200 microns to about 1000 microns.

17. The method of claim 16, further comprising coating an intermediate layer to overlie the first major surface of the backing prior to coating the abrasive layer.

18. The method of claim 16, further comprising coating or extrusion coating the backing.

19. An abrasive article comprising:

a backing including first and second major surfaces;

an abrasive layer disposed over the first major surface; and a back coat layer disposed over the second major surface, the back coat layer including a polymeric material and a fabric, wherein the back coat layer has a thickness of about 25 microns to about 100 microns.

20. A method of forming an abrasive article, the method comprising:

providing a backing having first and second major surfaces, the backing including a polyester film forming the first major surface and a back coat layer forming the second major surface, the back coat layer including a fabric bonded to the polyester film by a polymeric material; and coating an abrasive layer to overlie the first major surface of the backing, wherein the back coat layer has a thickness of about 25 microns to about 100 microns.

* * * * *